US012152389B2

(12) United States Patent
Dombowsky et al.

(10) Patent No.: US 12,152,389 B2
(45) **Date of Patent: *Nov. 26, 2024**

(54) PREFABRICATED INSULATED BUILDING PANEL WITH CURED CEMENTITIOUS LAYER BONDED TO INSULATION

(71) Applicant: NEXII BUILDING SOLUTIONS INC., Vancouver (CA)

(72) Inventors: Michael Anthony Dombowsky, Moose Jaw (CA); Benedict John Dombowsky, Moose Jaw (CA)

(73) Assignee: NEXII BUILDING SOLUTIONS INC.

( * ) Notice: Subject to any disclaimer, the term of this patent is extended or adjusted under 35 U.S.C. 154(b) by 0 days.

This patent is subject to a terminal disclaimer.

(21) Appl. No.: 17/216,390

(22) Filed: Mar. 29, 2021

(65) Prior Publication Data

US 2021/0238849 A1 Aug. 5, 2021

Related U.S. Application Data

(63) Continuation of application No. 16/274,460, filed on Feb. 13, 2019, now Pat. No. 10,961,708.

(30) Foreign Application Priority Data

Feb. 13, 2018 (CA) ..... 2994868

(51) Int. Cl.
*E04C 2/288* (2006.01)
*E04B 1/80* (2006.01)
*E04C 5/00* (2006.01)

(52) U.S. Cl.
CPC ..... *E04C 2/288* (2013.01); *E04B 1/80* (2013.01); *E04C 5/00* (2013.01)

(58) Field of Classification Search
CPC ..... B32B 2607/00; B32B 3/30; E04B 1/80; E04C 2/20; E04C 2/46; E04C 2/205;
(Continued)

(56) References Cited

U.S. PATENT DOCUMENTS 2,087,541 A 7/1937 Koester
2,199,112 A 4/1940 O'Leary
(Continued)

FOREIGN PATENT DOCUMENTS

CA 2078062 A1 3/1993
CA 2400122 A1 2/2004
(Continued)

OTHER PUBLICATIONS

Patent Cooperation Treaty International Search Report dated May 16, 2019 issued for the parent application assigned International Application No. PCT/CA2019/050179 with an International Filing Date of Feb. 13, 2019.
(Continued)

*Primary Examiner* — James J Buckle, Jr.
(74) *Attorney, Agent, or Firm* — Oyen Wiggs Green & Mutala LLP

(57) ABSTRACT

A prefabricated insulated building panel features a sheet of rigid thermally insulating material, an inner structural layer connected to one face of the insulating material, and an outer layer of cured composite cementitious material connected to an opposite second face of the rigid insulating material with a thickness allowing the cured composite cementitious layer to be supported at the insulating material by bonding action therewith. The panel also features channels at the interface between the composite cementitious outer layer and the insulating material formed by grooves in the second face of the insulating material extending to a periphery of the panel. These channels afford pressure equalization and moisture
(Continued)

drainage capabilities to the panel. Additionally, the inner structural layer comprises a layer of cured composite cementitious material bonded to the insulating material, which has a thickened edge portion along the periphery of the panel compared to strengthen the panel.

6 Claims, 6 Drawing Sheets

(58) Field of Classification Search
CPC ..... E04C 2/243; E04C 2/246; E04C 2/284; E04C 2/288; E04C 2/296; E04C 2/521; E04C 2/523; E04C 5/00; E04F 13/007; E04F 13/0864; E04F 13/0866; E04F 13/864; E04F 13/0869; E04F 17/00; E04F 2203/04; Y10T 428/192; Y10T 428/14744; Y10T 428/249953; E04D 31/025; E04D 3/357
USPC ..... 52/405.3
See application file for complete search history.

(56) References Cited

U.S. PATENT DOCUMENTS 2,222,037 A 11/1940 Lafferty
3,307,312 A 3/1967 Kreibaum
3,313,073 A 4/1967 Mathews
3,323,267 A 6/1967 Fish
3,557,503 A 1/1971 Snyder
3,580,202 A 5/1971 Thompson
3,621,635 A 11/1971 De Lange
3,693,308 A 9/1972 Trezzini
3,755,976 A 9/1973 Dolhaine
3,768,225 A 10/1973 Sloan
3,984,957 A 10/1976 Piazza
4,014,143 A 3/1977 Purcell
4,055,928 A 11/1977 Magerle
4,084,362 A 4/1978 Piazza
4,181,286 A 1/1980 Van Doren
4,186,536 A 2/1980 Piazza
4,232,494 A 11/1980 Bauch
4,233,787 A 11/1980 Piazza
4,252,767 A 2/1981 Piazza
4,282,691 A 8/1981 Risdon
4,318,258 A * 3/1982 Heck ..... E04F 13/04 52/453
4,318,361 A 3/1982 Sluys
4,375,741 A 3/1983 Paliwoda
4,512,126 A 4/1985 Walston
4,524,604 A 6/1985 Vondran
4,561,225 A 12/1985 Gartner
4,606,165 A 8/1986 Allan
4,632,796 A 12/1986 Moulet
4,676,035 A 6/1987 GangaRao
4,712,349 A * 12/1987 Riley ..... E04D 11/02 52/309.12
4,774,794 A 10/1988 Grieb et al.
4,811,536 A 3/1989 Hardt
4,835,034 A 5/1989 Cruz
4,841,702 A * 6/1989 Huettemann ..... E04B 5/04 52/794.1
4,937,993 A 7/1990 Hitchins
4,944,127 A 7/1990 Clear
4,974,380 A 12/1990 Bernander
5,030,502 A 7/1991 Teare
5,056,281 A * 10/1991 McCarthy ..... E04B 1/0007 52/169.5
5,065,558 A 11/1991 Boatsman
5,186,883 A 2/1993 Beall, III
5,217,000 A 6/1993 Pierce-Bjorklund
5,245,810 A 9/1993 Foss
5,283,999 A 2/1994 Cooney
5,289,664 A 3/1994 Rizza
5,293,725 A 3/1994 Matticks
5,372,769 A * 12/1994 Ryberg ..... B28B 23/0068 264/254
5,410,852 A 5/1995 Edgar
5,440,846 A * 8/1995 Record ..... C04B 28/02 52/412
5,440,847 A 8/1995 Butler
5,471,804 A 12/1995 Winter, IV
5,505,031 A 4/1996 Heydon
5,657,606 A 8/1997 Ressel
5,697,189 A 12/1997 Miller
5,704,172 A * 1/1998 Gougeon ..... A01M 1/245 52/169.5
5,713,296 A 2/1998 Gervasi
5,771,645 A 6/1998 Porter
5,839,249 A 11/1998 Roberts
5,927,032 A * 7/1999 Record ..... E04C 2/288 52/412
5,943,775 A 8/1999 Lanahan
5,968,615 A 10/1999 Schlappa
6,006,480 A 12/1999 Rook
6,041,561 A 3/2000 LeBlang
6,041,562 A 3/2000 Martella et al.
6,044,603 A 4/2000 Bader
6,164,035 A 12/2000 Roberts
6,223,485 B1 5/2001 Beck
6,240,691 B1 6/2001 Holzkaemper et al.
6,308,491 B1 10/2001 Porter
6,332,298 B1 12/2001 Bigelow
6,405,509 B1 6/2002 Razl
6,418,686 B1 * 7/2002 Record ..... E04C 2/288 52/412
6,438,923 B2 8/2002 Miller
6,460,297 B1 10/2002 Bonds
6,568,136 B2 5/2003 Aso
6,620,040 B2 * 9/2003 Rehbein ..... F24F 7/00 454/276
6,658,799 B1 12/2003 Stoodley
6,662,518 B1 12/2003 Devereux
6,729,085 B2 5/2004 Newhouse
6,857,377 B2 2/2005 Herring
6,869,669 B2 3/2005 Jensen
6,892,504 B1 5/2005 diGirolamo
7,188,455 B2 3/2007 Brugeaud
7,325,325 B2 * 2/2008 Gleeson ..... E04C 2/043 33/563
7,530,204 B2 5/2009 Cook
7,627,997 B2 12/2009 Messenger
7,762,040 B2 * 7/2010 Wilson ..... E04F 13/141 52/553
7,877,954 B1 2/2011 Saebi
8,065,846 B2 11/2011 McDonald
8,082,718 B2 12/2011 Esbaum
8,276,328 B2 10/2012 Pepin
8,381,484 B2 2/2013 Bonds
8,567,153 B1 * 10/2013 Francavilla ..... E04C 2/384 52/309.4
8,601,758 B2 12/2013 Biadora
8,607,522 B2 12/2013 MacDonald
8,733,046 B2 5/2014 Naidoo
8,756,889 B2 6/2014 LeBlang
8,769,894 B2 * 7/2014 Power ..... E04B 1/7076 52/302.1
8,833,023 B2 9/2014 Masure
8,844,227 B1 9/2014 Ciuperca
8,857,123 B2 * 10/2014 Culpepper ..... E04F 13/0878 52/302.1
8,910,439 B2 12/2014 Ingjaldsdottir
8,919,062 B1 12/2014 Viness
8,950,154 B1 2/2015 Casey
9,328,506 B2 5/2016 Gibson
9,376,815 B1 6/2016 Santini
9,388,561 B2 7/2016 Johnson
9,399,867 B2 7/2016 Di Lorenzo
9,598,891 B2 3/2017 Knoblauch et al.
9,617,724 B2 4/2017 Lubberts
9,649,662 B2 5/2017 Strachan
9,649,663 B2 5/2017 Strachan

(56) References Cited

U.S. PATENT DOCUMENTS

| | | | | |
|---|---|---|---|---|
| 9,725,902 | B1* | 8/2017 | Chugh | E04C 2/326 |
| 9,879,400 | B1* | 1/2018 | Walker | E02D 19/06 |
| 9,920,528 | B1* | 3/2018 | Biesiadecki | B32B 3/08 |
| 9,957,713 | B2 | 5/2018 | Dixon | |
| 10,077,550 | B2 | 9/2018 | Pilz | |
| 10,077,553 | B2 | 9/2018 | Neumayr | |
| 10,145,108 | B2 | 12/2018 | Chugh et al. | |
| 10,253,465 | B2 | 4/2019 | Preston | |
| 10,323,413 | B1* | 6/2019 | Biesiadecki | E04C 2/46 |
| 10,370,844 | B2 | 8/2019 | Lomax | |
| 10,370,845 | B2 | 8/2019 | Francies, III | |
| 10,370,848 | B2 | 8/2019 | Karns | |
| 10,422,141 | B1 | 9/2019 | Harkins | |
| 10,508,434 | B2 | 12/2019 | Morcous | |
| 10,577,798 | B1 | 3/2020 | Hodgson | |
| 10,633,854 | B1 | 4/2020 | Zeigler, Jr. | |
| 10,796,492 | B2 | 10/2020 | Pulitzer | |
| 11,109,519 | B2 | 8/2021 | Deighton | |
| 11,118,344 | B2 | 9/2021 | Tiramani | |
| 11,236,505 | B2 | 2/2022 | Rivas | |
| 11,572,683 | B2 | 2/2023 | Alhems | |
| 2002/0043045 | A1 | 4/2002 | Marino Del Din | |
| 2002/0139082 | A1 | 10/2002 | DeFord | |
| 2003/0003271 | A1 | 1/2003 | Bykov et al. | |
| 2003/0024192 | A1* | 2/2003 | Spargur | B29C 44/0407 52/309.4 |
| 2005/0050821 | A1 | 3/2005 | Brugeaud | |
| 2005/0081468 | A1* | 4/2005 | Wilson | E04F 13/0846 52/528 |
| 2005/0204698 | A1 | 9/2005 | Werner | |
| 2007/0044402 | A1 | 3/2007 | Hess | |
| 2007/0131308 | A1 | 6/2007 | Martin | |
| 2007/0209306 | A1 | 9/2007 | Andrews | |
| 2007/0234669 | A1 | 10/2007 | Gembala | |
| 2008/0034690 | A1* | 2/2008 | Gartz | E04B 1/70 52/309.4 |
| 2008/0078134 | A1 | 4/2008 | Roby | |
| 2008/0141608 | A1 | 6/2008 | Logan | |
| 2009/0249741 | A1 | 10/2009 | Cancian | |
| 2010/0050555 | A1 | 3/2010 | Knight | |
| 2010/0058687 | A1 | 3/2010 | Normand | |
| 2010/0107536 | A1 | 5/2010 | Tautari | |
| 2011/0023410 | A1 | 2/2011 | Hernandez Gallardo | |
| 2011/0162306 | A1 | 7/2011 | Stanley | |
| 2011/0192111 | A1 | 8/2011 | White | |
| 2011/0252728 | A1* | 10/2011 | Scherrer | E04B 1/7675 52/302.1 |
| 2011/0268916 | A1 | 11/2011 | Pardue, Jr. | |
| 2011/0305868 | A1 | 12/2011 | Heytens | |
| 2012/0011792 | A1 | 1/2012 | DeWildt | |
| 2012/0073223 | A1* | 3/2012 | Wilson | E04F 13/141 52/302.1 |
| 2012/0174511 | A1 | 7/2012 | Harding | |
| 2012/0216476 | A1 | 8/2012 | Naidoo | |
| 2012/0317904 | A1 | 12/2012 | Hartmann | |
| 2012/0324814 | A1* | 12/2012 | Amend | E04B 1/765 52/302.1 |
| 2014/0059961 | A1 | 3/2014 | Yin et al. | |
| 2014/0087158 | A1 | 3/2014 | Ciuperca | |
| 2014/0141160 | A1 | 5/2014 | Strachan | |
| 2014/0260030 | A1 | 9/2014 | Propst | |
| 2015/0047281 | A1* | 2/2015 | Cole | E04F 13/007 52/302.1 |
| 2015/0099083 | A1 | 4/2015 | Spieth | |
| 2015/0159373 | A1 | 6/2015 | Warren | |
| 2015/0300006 | A1 | 10/2015 | Lanese | |
| 2016/0060863 | A1 | 3/2016 | Deiss | |
| 2016/0281413 | A1 | 9/2016 | Knoblauch | |
| 2016/0319555 | A1* | 11/2016 | Norwood | E04F 13/0864 |
| 2017/0121961 | A1 | 5/2017 | Hodson | |
| 2017/0175408 | A1 | 6/2017 | Lubberts | |
| 2017/0335567 | A1* | 11/2017 | Chugh | E04C 2/526 |
| 2018/0258633 | A1* | 9/2018 | Power | E04C 2/322 |
| 2018/0328044 | A1* | 11/2018 | Joshi | E04F 13/0869 |
| 2019/0093343 | A1 | 3/2019 | Dimitrakopoulos | |
| 2019/0276362 | A1 | 9/2019 | Winkelman et al. | |
| 2019/0284804 | A1 | 9/2019 | Ibrahim | |
| 2019/0338533 | A1* | 11/2019 | Palladino | B32B 27/40 |
| 2020/0040574 | A1 | 2/2020 | Ekster et al. | |
| 2020/0048022 | A1 | 2/2020 | Deiss | |
| 2020/0048904 | A1 | 2/2020 | Dombowsky et al. | |
| 2020/0165811 | A1 | 5/2020 | Vita, Jr. | |
| 2020/0299960 | A1 | 9/2020 | Sharma | |
| 2020/0385982 | A1 | 12/2020 | Morcous | |
| 2020/0392731 | A1 | 12/2020 | Sloane | |
| 2021/0025156 | A1 | 1/2021 | Dombowsky | |
| 2021/0285214 | A1 | 9/2021 | Moses | |
| 2021/0301528 | A1 | 9/2021 | Dombowsky et al. | |
| 2022/0090380 | A1 | 3/2022 | Dombowsky | |
| 2022/0316210 | A1 | 10/2022 | Argyrou | |
| 2022/0403653 | A1 | 12/2022 | Dombowsky | |

FOREIGN PATENT DOCUMENTS

| | | | |
|---|---|---|---|
| CA | 2994868 | A1 | 4/2018 |
| CA | 3033991 | A1 | 4/2018 |
| CN | 101173567 | A | 5/2008 |
| CN | 101942894 | A | 1/2011 |
| CN | 101265723 | B | 8/2012 |
| CN | 102230315 | B | 8/2012 |
| CN | 204531034 | U | 5/2015 |
| CN | 204456716 | U | 7/2015 |
| CN | 204899014 | U | 12/2015 |
| CN | 105822009 | A | 8/2016 |
| CN | 206616764 | U | 11/2017 |
| CN | 207905129 | U | 9/2018 |
| DE | 10300024 | A1 | 7/2004 |
| DE | 10039673 | A1 | 11/2004 |
| DE | 102014208294 | A1 | 11/2015 |
| EP | 3339531 | A1 | 6/2018 |
| EP | 3564456 | A1 | 11/2019 |
| FR | 989138 | A | 9/1951 |
| FR | 1008976 | A | 5/1952 |
| FR | 1310670 | A | 11/1962 |
| GB | 1328330 | A | 8/1973 |
| GB | 2393456 | A | 3/2004 |
| GB | 2525100 | A | 10/2015 |
| JP | 57101203 | | 12/1980 |
| JP | 57174031 | | 4/1981 |
| JP | 62111054 | A | 5/1987 |
| JP | 10140694 | A | 5/1998 |
| JP | 2009-263958 | A | 11/2009 |
| KR | 10-2010-0021605 | A | 2/2010 |
| KR | 101613694 | B1 | 4/2016 |
| KR | 101624311 | B1 | 5/2016 |
| NL | 2014990 | B1 | 1/2017 |
| WO | 8501766 | A1 | 4/1985 |
| WO | 0238879 | A1 | 5/2002 |
| WO | 2007147178 | | 12/2007 |
| WO | 2015054735 | A1 | 4/2015 |
| WO | 2015121762 | | 8/2015 |
| WO | 2022056458 | A1 | 3/2022 |

OTHER PUBLICATIONS

Patent Cooperation Treaty Written Opinion of the International Searching Authority dated May 16, 2019 issued for the parent application assigned International Application No. PCT/CA2019/050179 with an International Filing Date of Feb. 13, 2019.

* cited by examiner

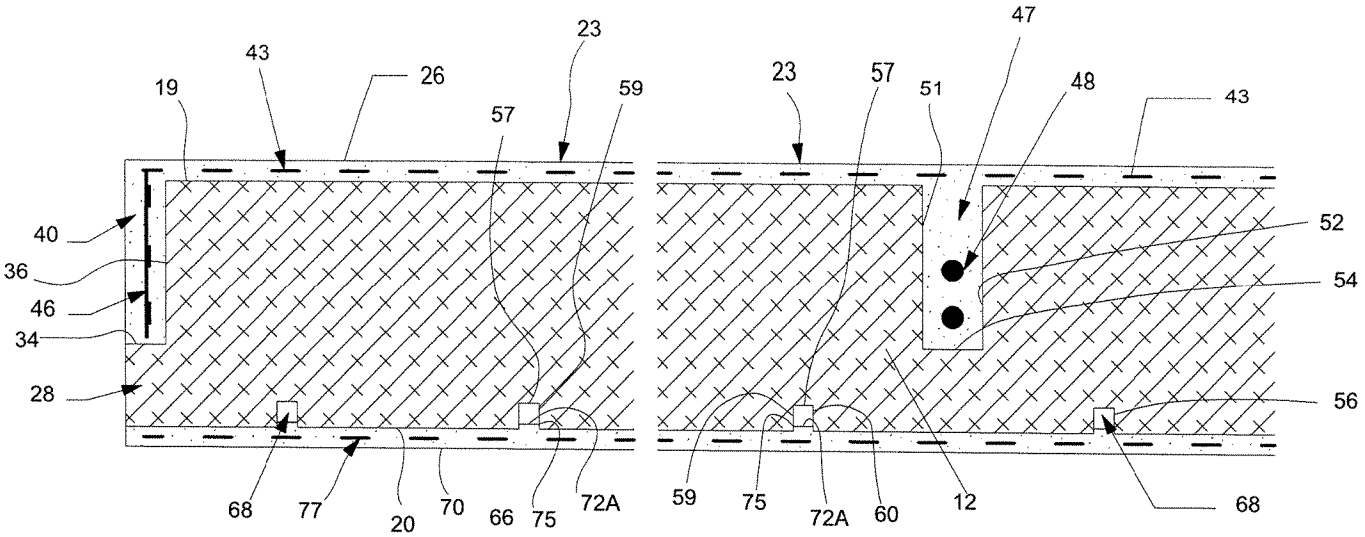
FIG. 5
FIG. 4
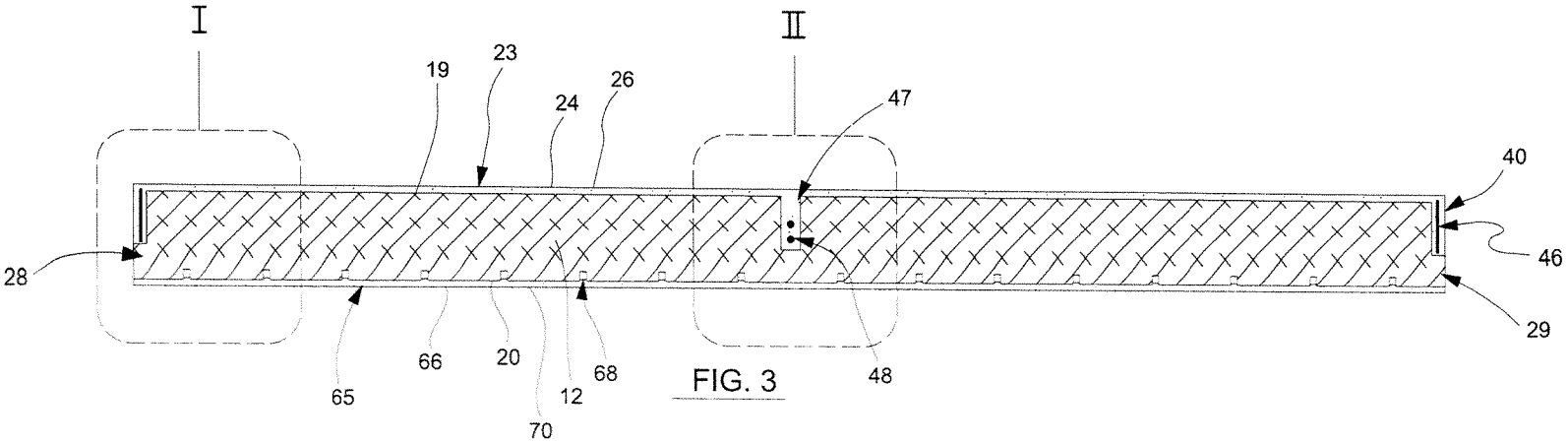
FIG. 3

PREFABRICATED INSULATED BUILDING PANEL WITH CURED CEMENTITIOUS LAYER BONDED TO INSULATION

This application is a continuation of U.S. patent application Ser. No. 16/274,460 entitled PREFABRICATED INSULATED BUILDING PANEL WITH CURED CEMENTITIOUS LAYER BONDED TO INSULATION filed 13 Feb. 2019 which claims foreign priority on Canadian Patent Application Serial No. 2,994,868 filed 13 Feb. 2018. Each of the foregoing applications is hereby incorporated herein by reference in its entirety for all purposes.

FIELD OF THE INVENTION

The present invention relates generally to prefabricated insulated building panels with at least one cured cementitious layer which may be assembled to form walls, floors, and roofs of buildings, and more particularly to such panels having channels to expel fluid and a pair of cured cementitious layers connected to opposite faces of the insulating material.

BACKGROUND

Structural insulated panels (SIPs) have a well-established place in the building industry. This type of prefabricated, plant-built panel typically comprises a thick closed cell insulating material such as expanded polystyrene (EPS) and a structural skin bonded thereto. Presently, two types of structural skin are commonly used, being bonded to the EPS with adhesive, for example, oriented strand board (OSB) wood sheeting or magnesium oxide board also known in industry as concrete board.

A shortcoming of a building system employing SIPs is the size of the panels, which is generally limited to the size of the wood or concrete board sheets that are mass produced. This results in a wall, floor or roof being made of a plurality of SIP panels with a plurality of joints. Additionally, the prior art panels typically require an additional exterior layer to be affixed to the SIP for weather proofing and ornamentation, that is, at what is otherwise an exterior face of the wooden or concrete sheet. Furthermore, an interior of a SIP-formed building is typically required to receive a layer of gypsum sheetrock and paint to finish its interior. To date, the load bearing capacity of OSB SIPs is limited to two stories.

Precast concrete sandwich panels address limitations of SIPs, having a suitable exterior finish, greater load bearing capacity and typically being sized larger so as to use fewer joints when assembled with other like panels as compared to SIPs. A shortcoming of this type of panel, however, is the excessive weight compared to a SIP. Despite the drawbacks which are associated with the increased weight, precast sandwich concrete panels provide improved loadbearing and fire-related performance in comparison to SIPs.

SUMMARY OF THE INVENTION

According to an aspect of the invention there is provided a prefabricated insulated building panel comprising:

a sheet of rigid insulating material having opposite first and second sides and opposite first and second ends collectively delimiting a first face and a second face of the sheet facing in opposite directions and collectively defining a periphery of the sheet of rigid insulating material;

an inner structural layer connected to the first face of the rigid insulating material;

the rigid insulating material defining in the second face thereof a plurality of grooves each having a base recessed from the second face of the rigid insulating material;

the grooves each extend from a location on the second face of the rigid insulating material to the periphery of the sheet so as to be open at an end of the respective groove which terminates at the periphery of the sheet;

composite cementitious material bonded to the second face of the rigid insulating material to provide a cured cementitious outer layer with a thickness measured from the second face of the rigid insulating material to an outer face of the outer layer such that the cured cementitious layer is supported at the second face of the rigid insulating material by bonding action with the rigid insulating material;

the composite cementitious material covering the grooves so as to define tubular channels which are closed opposite the bases of the grooves to define circumferentially enclosed paths for fluid flow from locations within the periphery of the panel to an outside of the panel.

According to another aspect of the invention there is provided a prefabricated insulated building panel comprising:

a sheet of rigid insulating material having opposite first and second sides and opposite first and second ends collectively delimiting a first face and a second face of the sheet facing in opposite directions and collectively defining a periphery of the sheet of rigid insulating material;

an inner structural layer connected to the first face of the rigid insulating material;

the inner structural layer comprising composite cementitious material bonded to the first face of the rigid insulating material to provide a cured cementitious inner layer with a thickness measured from the first face of the rigid insulating material to an outer face of the inner layer such that the cured cementitious layer is supported at the first face of the rigid insulating material by bonding action with the rigid insulating material;

composite cementitious material bonded to the second face of the rigid insulating material to provide a cured cementitious outer layer with a thickness measured from the second face of the rigid insulating material to an outer face of the outer layer such that the cured cementitious layer is supported at the second face of the rigid insulating material by bonding action with the rigid insulating material;

at least one of (i) the first and second sides, or (ii) the first and second ends of the rigid insulating material forming a pair of opposite flanges extending outwardly so as to define ledge surfaces along the periphery of the rigid insulating material which are oriented generally parallel to the first face of the rigid insulating material but recessed therefrom so that each one of the ledge surfaces is interconnected with the first face by a transition surface oriented transversely to the respective ledge surface and the first face;

the cured cementitious inner layer wrapping about edges formed between the first face of the rigid insulating material and the transition surfaces and extending to the ledge surfaces;

the cured cementitious inner layer being bonded to the ledge surfaces;

the cured cementitious inner layer being continuous from one of the ledge surfaces and across the first face of the rigid insulating material to the other one of the ledge surfaces;

a thickness of the cured cementitious inner layer from the ledge surfaces to the outer face of the inner layer being greater than the thickness of the cured cementitious inner layer at the first face of the rigid insulating material.

Thus the bonding action effected during curing of the composite cementitious material to the rigid insulating material is alone able to carry the weight of a prescribed thickness of cured cementitious layer without directly anchoring the cementitious layer to the inner structural layer, for example by fasteners passed through the thickness of the insulating material.

The second aspect provides an arrangement having thickened cured cementitious edges along a perimeter of the panel to further rigidify the panel in a direction spanning between an opposite pair of thickened edges so that the panel even with relatively thin cured cementitious layers is strong enough to maintain its shape and original condition without bending or the cured cementitious layers cracking throughout production and during shipping and installation.

In such arrangements where the cementitious outer layer is not directly anchored to the inner structural layer such that there are no thermally conductive elements such as fasteners passing through full thickness of the insulating material to connect the composite cementitious material to the inner structural layer, there are therefore no thermal bridges along which thermal energy may undesirably pass through in a thickness direction of the panel. An uninterrupted insulating blanket is therefore formed by the respective panel.

Moreover, provision of relatively thin cured cementitious layers reduces weight of the panel making them easier to work with including transport and arranging them into place to form portions of a building for example using a crane.

Thickened edges along the perimeter of the panel further rigidify the panel in a direction spanning between each opposite pair of thickened edges so that the panel even with relatively thin cured cementitious layers is strong enough to maintain its shape and original condition without bending or the cured cementitious layers cracking throughout production and during shipping and installation.

Thus larger panels can be plant-built so as to reduce the number of panels used to integrally form a common part of the building being constructed, for example a floor or a wall or an elevator shaft, thereby reducing the number of joints thereof and accordingly the labor for on-site assembly.

Also, panels can be substantially finished including any finishing for exterior and interior sides of panels.

Furthermore, the channels formed and located at the interface between the cementitious outer layer and the rigid insulating material provide the functionality of expelling wind-driven moisture which penetrates the outer layer when the panel in use in forming a wall is exposed to the ambient environment and the elements by gravity to an outside of the panel. The channels provide the wall panel with an air space between an exterior "rain screen" and the rigid insulating material, which has the effect of allowing the panel to "pressure equalize" which when exposed to high wind conditions with rain prevents moisture from being drawn into the building.

Additionally, when in use in forming a floor the channels define conduits for carrying plumbing such water lines and in-floor radiant heating pipes.

Yet further, when in use in forming a roof or ceiling the channels define conduits for carrying fire sprinkler and water lines and electrical wiring.

During manufacturing, when the cementitious outer layer is formed by placing a partially formed panel including the rigid insulating material with the grooves into unset composite cementitious material confined by a form on a horizontal casting bed, these grooves allow entrapped pockets of air to escape along the grooves to the outside of the panel. Thus bonding occurs across an entire surface of the rigid insulating material which comes into contact with the unset composite cementitious material.

'Composite cementitious material' as used in this disclosure refers to a material comprising a plurality of constituent materials including cement which when cured forms a hard durable material. Examples of composite cementitious materials include concrete and cementitious resin-based coating.

Preferably, the composite cementitious material wraps about outer edges of the grooves formed between the second face of the rigid insulating material and sidewalls of the grooves which extend from the second face to the respective base such that the composite cementitious material extends into the grooves so that the channels each are collectively defined by the composite cementitious material spanning from one of the sidewalls of the respective groove to the other, the base of the groove, and a portion of each one of the sidewalls of the groove. This extension of the composite cementitious material into the grooves and attachment to the side walls thereof provides a stronger bond of the cured cementitious layer to the insulating material.

Typically, the grooves are arranged in an intersecting array such that at least one of the grooves extends through one other groove. Thus a standardized layout of the grooves is suitably functional for any application of the panel whether as a wall, roof or floor panel.

In such an arrangement, the grooves typically form a grid with a first set of the grooves extending each parallel to the other in a direction from one side or end of the insulating material towards another side or end and a second set of the grooves extending each parallel to the other and transversely to the first set in a direction from one side or end of the insulating material towards another side or end.

Preferably, a depth of each one of the grooves measured from the second face of the insulating material to the base of the respective groove is less than half of the thickness of the insulating material measured from the first face to the second face. This leaves sufficient insulating material between the channels and the inner structural layer to provide substantially similar thermally insulating properties as if there were no such channels present.

Preferably, the inner structural layer comprises composite cementitious material bonded to the first face of the rigid insulating material to provide a cured cementitious inner layer with a thickness measured from the first face of the rigid insulating material to an outer face of the inner layer such that the cured cementitious layer is supported at the first face of the rigid insulating material by bonding action with the rigid insulating material.

Preferably, the inner structural layer and the cured cementitious outer layer are separated from one another by a thickness of rigid insulating material.

Typically, a surface area of the second face of the rigid insulating material is planar.

Typically, a surface area of the first face of the rigid insulating material is planar.

Preferably, the thickness of the rigid insulating material measured from the first face to the second face is in the order of 3 to 30 times the thickness of the cured cementitious outer layer.

Preferably, the thickness of each one of the cured cementitious inner layer at the first face of the rigid insulating material and the cured cementitious outer layer at the second face of the rigid insulating material is in a range from 0.25 inches to 1.5 inches.

Typically, the flanges are flush with the second face of the rigid insulating material, such that a surface area of the second face is greater than the first face, and the cured cementitious outer layer which covers substantially a whole of the second face of the rigid insulating material is separated from the cured cementitious inner layer by a thickness of the rigid insulating material at the flanges.

Preferably, both (i) the first and second sides, and (ii) the first and second ends of the rigid insulating material respectively form opposite ones of the ledge surfaces such that the cured cementitious inner layer is thickened around a whole of the periphery of the sheet of rigid insulating material.

In one arrangement, the cured cementitious inner layer comprises a continuous embedded reinforcing substrate spanning from one of the opposite flanges to the other.

In one arrangement, each one of the inner and outer cured cementitious layers is free of interconnecting fasteners which extend from a location within one of the cured cementitious inner and outer layers through a thickness of the rigid thermally insulating material and to the other one of the cured cementitious inner and outer layers so as to interconnect the cured cementitious inner and outer layers.

According to yet another aspect of the invention there is provided a prefabricated insulated building panel comprising:

a sheet of rigid thermally insulating material having opposite first and second sides and opposite first and second ends collectively delimiting a first face and a second face of the sheet facing in opposite directions and collectively defining a periphery of the sheet of rigid insulating material;

an inner structural layer connected to the first face of the rigid thermally insulating material for carrying load exerted on the panel;

the rigid thermally insulating material defining in the second face thereof a plurality of grooves each having a base recessed from the second face of the rigid thermally insulating material;

the grooves each extending from a location on the second face of the rigid thermally insulating material to the periphery of the sheet so as to be open at an end of the respective groove which terminates at the periphery of the sheet;

composite cementitious material bonded to the second face of the rigid thermally insulating material to provide a cured cementitious outer layer with a thickness measured from the second face of the rigid thermally insulating material to an outer face of the outer layer such that the cured cementitious layer is supported at the second face of the rigid insulating material by bonding action with the rigid thermally insulating material;

the composite cementitious material covering the grooves so as to define circumferentially enclosed channels which are closed opposite the bases of the grooves to define paths for fluid flow from locations within the periphery of the panel to an outside of the panel; and the composite cementitious material wrapping about outer edges of the grooves formed between the second face of the rigid thermally insulating material and sidewalls of the grooves which extend from the second face to the respective base such that the composite cementitious material extends into the grooves so that the channels each are collectively defined by the composite cementitious material spanning from one of the sidewalls of the respective groove to the other, the base of the groove, and a portion of each one of the sidewalls of the groove.

According to yet another aspect of the invention there is provided a prefabricated insulated building panel comprising:

a sheet of rigid thermally insulating material having opposite first and second sides and opposite first and second ends collectively delimiting a first face and a second face of the sheet which face in opposite directions and collectively defining a periphery of the sheet of rigid thermally insulating material;

at least one of (i) the first and second sides, or (ii) the first and second ends of the rigid thermally insulating material forming a pair of opposite flanges extending outwardly so as to define ledge surfaces along the periphery of the rigid thermally insulating material which are oriented generally parallel to the first face of the rigid thermally insulating material but recessed therefrom so that each one of the ledge surfaces is interconnected with the first face by a transition surface oriented transversely to the respective ledge surface and the first face;

composite cementitious material bonded to the first face, the ledge surfaces and the transition surfaces of the rigid thermally insulating material to provide a first continuous cured cementitious layer extending from one of the ledge surfaces and across the first face of the rigid thermally insulating material to the other one of the ledge surfaces, the first cured cementitious layer having a thickness measured from the first face of the rigid thermally insulating material to an outer face of the first cured cementitious layer that is opposite to said first face and to the ledge surfaces;

composite cementitious material bonded to the second face of the rigid thermally insulating material to provide a second cured cementitious layer with a thickness measured from the second face of the rigid thermally insulating material to an outer face of the second cured cementitious layer opposite thereto; and the first and second cured cementitious layers each being sized in thickness between the outer face thereof and a corresponding one of the first and second faces of the rigid thermally insulating material so as to be supported at the corresponding one of the first and second faces of the rigid thermally insulating material by bonding action therewith.

Preferably, the thickness of each of the first and second cured cementitious layers between the outer face thereof and the corresponding one of the first and second faces of the rigid thermally insulating material is in a range from 0.25 inches to 1.5 inches.

In one arrangement, the flanges are flush with the second face of the rigid thermally insulating material, such that a surface area of the second face is greater than a surface area of the first face, and the cured cementitious outer layer which covers substantially a whole of the second face of the rigid thermally insulating material is separated from the cured cementitious inner layer by a thickness of the rigid thermally insulating material at the flanges.

In one arrangement, both (i) the first and second sides, and (ii) the first and second ends of the rigid thermally insulating material respectively form opposite ones of the ledge surfaces such that the first cured cementitious layer is thickened around a whole of the periphery of the sheet of rigid thermally insulating material.

In one arrangement, the first cured cementitious layer comprises a continuous embedded reinforcing substrate spanning from one of the opposite flanges to the other.

In one arrangement, each one of the first and second cured cementitious layers is free of interconnecting fasteners which extend from a location within one of the cured cementitious inner and outer layers through a thickness of the rigid thermally insulating material and to the other one of the cured cementitious inner and outer layers so as to interconnect the first and second cured cementitious layers.

BRIEF DESCRIPTION OF THE DRAWINGS

The invention will now be described in conjunction with the accompanying drawings in which:

FIG. 3 is a cross-section taken along line 3-3 in FIG. 1 where some components are omitted for clarity of illustration;

FIG. 4 is an enlarged partial view indicated at I in FIG. 3;

FIG. 5 is an enlarged partial view indicated at II in FIG. 3;

In the drawings like characters of reference indicate corresponding parts in the different figures.

DETAILED DESCRIPTION

Figure 1:
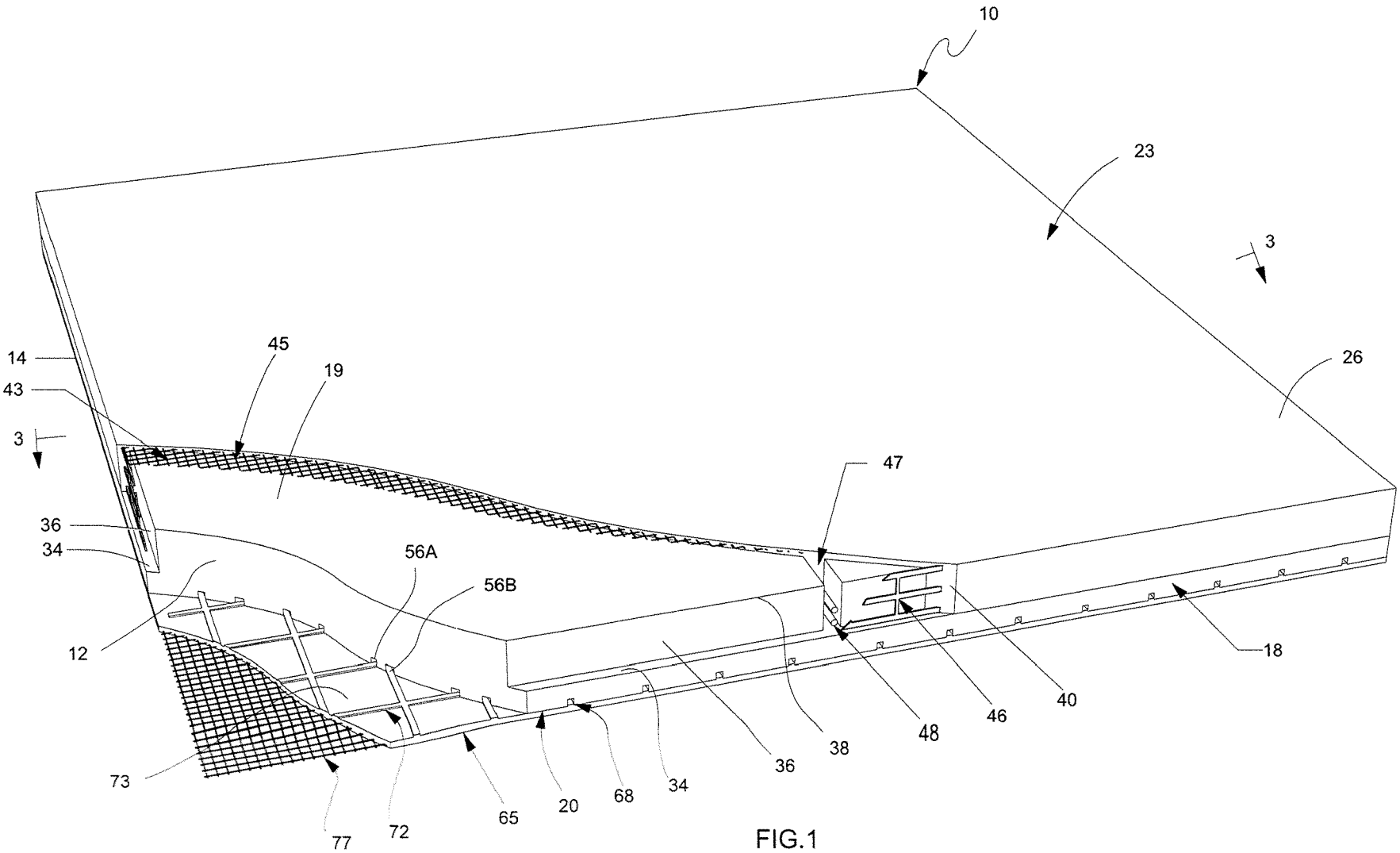
FIG. 1 is a perspective view of an arrangement of prefabricated insulated building panel according to the present invention, where a portion of the panel is cutaway so as to view various layers of the panel.
Figure 2:
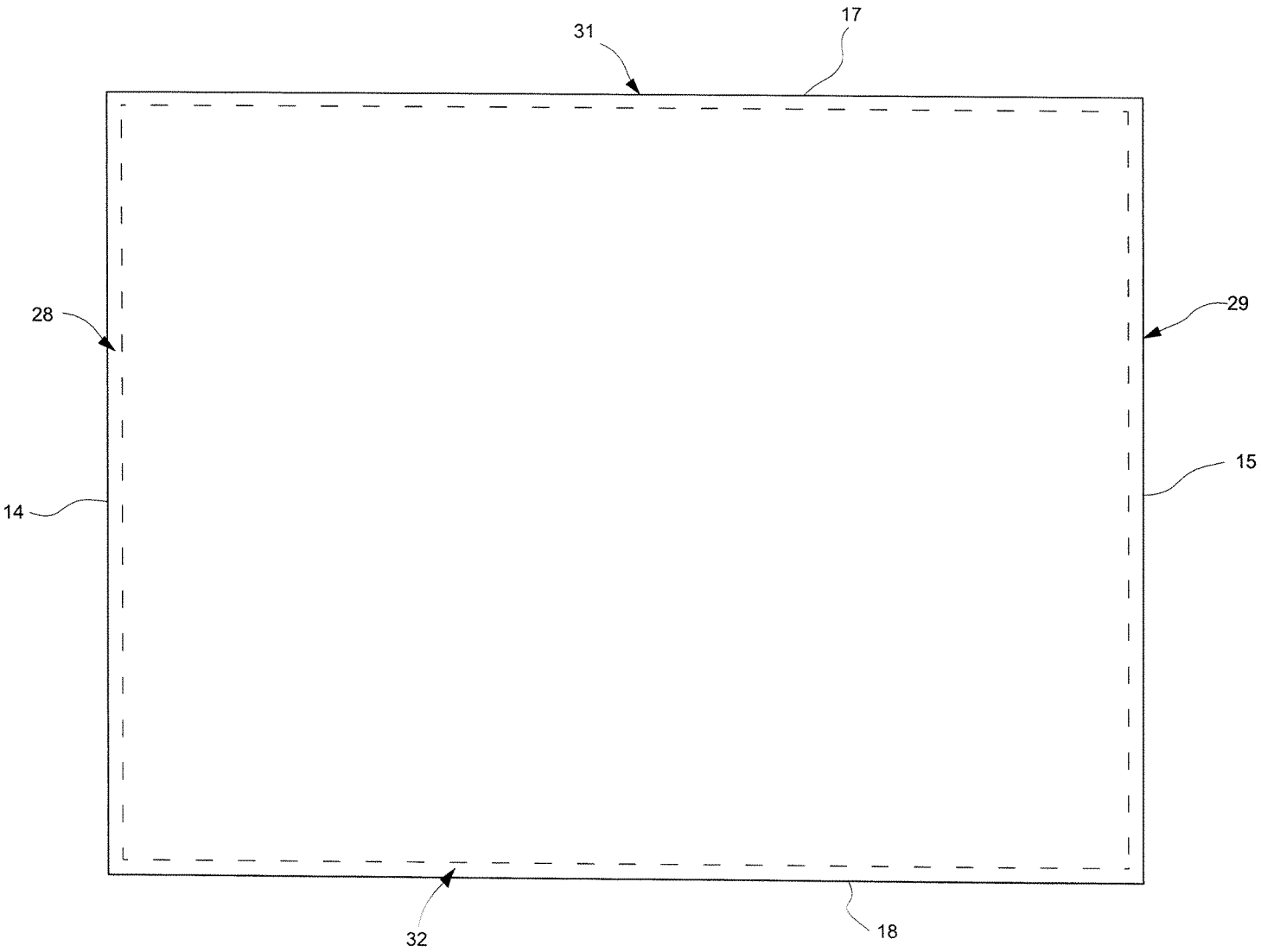
FIG. 2 is an elevational view of the arrangement of prefabricated insulated building panel of FIG. 1.

The accompanying figures illustrate a prefabricated insulated building panel which is usable with like panels for forming a wall, roof or floor of a building.

The panel indicated at 10 comprises a sheet of rigid, closed cell thermally insulating material 12 such as expanded polystyrene (EPS) (for example, EPS type 2), rigid mineral wool which in industry is also known as rigid rock wool, or rigid polyurethane or polyinosinate. The sheet of insulating material 12 is rectangular in overall shape and has opposite left and right sides 14, 15 and opposite top and bottom ends 17, 18 that collectively delimit inner and outer faces 19, 20 of the sheet, which are planar and parallel to one another and face in opposite directions. The left and right sides 14, 15 and top and bottom ends 17, 18 of the sheet also collectively delimit a periphery of the sheet of rigid insulating material 12. It will be appreciated that reference to, for example, the sides as left and right, and to the ends as top and bottom, is non-limiting and simply for convenient reference as the panel 10 can be oriented in a variety of ways depending on how it is used in construction of a building.

An inner structural layer 23 of the panel for carrying at least a portion of a load exerted on the panel comprises composite cementitious material 24 which has cured while disposed in contact with the insulating material 12 so that the cured cementitious layer is connected to the sheet of insulating material by bonding action to the inner face 19 of the sheet 12. The cured cementitious inner layer 23 has a thickness measured from the inner face 19 of the sheet to an outer or distal face 26 of the cementitious layer such that a weight of the amount of material forming the layer 23 can be supported in connection with the insulating material by bonding action alone.

The composite cementitious material 24 forming the cured cementitious inner layer 23 is non-shrinking, fast-curing, highly flexible, self leveling, fiber reinforced, and free of any crushed rock for best performance including during the manufacturing process when casting the layer and in use regarding strength of the panel. One example of such material comprises calcium sulfoaluminate (CSA) cement.

Each pair of the laterally spaced left and right sides 14, 15 and the longitudinally spaced top and bottom ends 17, 18 of the insulating material 12 forms a pair of opposite outwardly extending flanges 28, 29 and 31, 32 of less insulating material so as to have a smaller thickness than that measured between the inner and outer faces 19, 20. The flanges 28, 29 and 31, 32 define ledge surfaces 34 along the full periphery of the insulating sheet 12. The ledge surfaces 34 are planar and oriented parallel to the inner face 19 of the sheet 12, but they are recessed from the inner face 19 so that each one of the ledge surfaces is interconnected therewith by a planar transition surface 36 which is oriented perpendicularly transversely to the respective ledge surface 34 and the inner face. Thus the transition surfaces 36 are oriented normal to both the inner face 19 and the ledge surfaces 16. The flanges are formed as cut-outs of edge portions of the sheet 12 on the inner face 19 thereof where rectangular blocks are removed along edges of the inner face 19 of an initially wholly rectangular sheet of insulating material. A side of the respective one of the flanges 28, 29 and 31, 32 opposite the ledge surface 34 is planar and flush with the outer face 20 of the sheet 12 such that a surface area of the outer face 20 is greater than the inner face 19.

The cured cementitious inner layer 23 not only wholly covers the inner face 19 of the insulating material 12 but also wraps about edges 38 formed between the sheet's inner face 19 and the transition surfaces 36, and extends to the ledge surfaces 34 so as to be bonded to the ledge surfaces and is bonded to the transition surfaces 36, too. Thus there is formed at each opposite pair of ledge surfaces 34 a thickened edge portion 40 of the cured cementitious layer 23 having a thickness of cured composite cementitious material measured from the ledge surface 34 to the outer face 26 of the inner layer 23 which is greater than the thickness of the cured cementitious inner layer at the inner face 19 of the rigid insulating material, that is measured between the inner face 19 and the outer face 26 of the inner layer. The cured cementitious inner layer 23 is continuous from one ledge surface 34 of the respective opposite pair of ledge surfaces and across the inner face 19 to the other one of the ledge surfaces 34 of that pair so as to form a common integral layer of material which is thickened at its edges and along the whole of the periphery of the insulating sheet so as to rigidify the layer of cured cementitious material in both a lateral direction between opposite sides 14, 15 and in a longitudinal direction between opposite ends 17, 18 while minimizing weight of the layer by having reduced thickness at the inner face, which forms a majority of the inner layer 23. Each thickened edge portion 40 of the inner layer 23 comprises the increased thickness across a full width of the ledge surface 34 from its free distal end opposite the adjacent contiguous transition surface 36 to that surface 36. A width of the edge portion 40 measured between the transition surface 36 to the free end of the flange is substantially equal to the thickness of the layer 23 measured between the inner face 19 and the outer face 26 of the cementitious layer. During manufacturing of the panel the inner layer 23 is cast as a continuous layer, and the outer face 26 of the inner layer is planar across its full surface area which covers the inner face 19 of the insulation and each opposite pair of ledge surfaces 34.

The cured cementitious inner layer 23 also comprises a continuous reinforcing substrate 43 in the form of a flexible mesh, for example fibreglass scrim or carbon fiber mesh, which is embedded in the cured cementitious material 24. The reinforcing substrate 43 spans from one flange to the opposite flange in both the lateral and longitudinal directions of the panel. The substrate 43 is embedded in the layer 23 simply by resting the substrate 43 over the inner face 19 of the insulating sheet 12 and draping same over the edges 38 so as to depend downwardly to the ledge surfaces, and when unset composite cementitious material is poured this material flows around openings 45 defined in the mesh substrate such that the composite cementitious material cures with the substrate 43 embedded in an intermediate location between the insulating sheet and exposed outer surfaces of the inner layer 23. A secondary reinforcing substrate 46 also in the form of a mesh may be disposed in the thickened edge portions 40 in addition to the reinforcing substrate 43 spanning the full periphery of the reduced width portion of the insulating sheet 12 and oriented perpendicularly to the ledge surfaces 34 and extending generally from the ledge surface 34 towards the outer face 26 of the cured cementitious inner layer 23. Thus the two reinforcing substrates 43, 46 overlap one another at the thickened edge portions.

The insulating material 12 defines a central trough 47 in the inner face 19 receiving at least one metal reinforcing bar 48 extending longitudinally of the trough 47. The trough 47 which extends longitudinally of the insulating sheet and opens at either end 17, 18 has a pair of opposite sidewalls 51, 52 which are contiguous with the inner face 19 and extend therefrom to a trough base 54 which is parallel to but spaced recessed from the inner face 19. The trough base 54 is coplanar with the ledge surfaces 34 such that a depth of the trough 47 is equal to a distance in the thickness direction of the insulating sheet by which the ledge surfaces 34 are recessed from the inner face 19. The width of the trough 47 between the opposite sidewalls 51, 52 is about 1.5 inches. The at least one reinforcing bar 48 is disposed in the trough 47 at a spaced location from the trough base 54 and sidewalls 51, 52 and is supported thereat during manufacturing by a plurality of conventional cradles resting in the trough, so that the unset cementitious material flows into the trough and around the respective reinforcing bar by gravity. Thus is formed in the cured cementitious inner layer a T-beam as conventionally understood in the art.

The rigid insulating material 12 defines in its outer face 20 a plurality of elongate grooves 56 each with a base 57 recessed from the outer face 20 of the insulating sheet 12 and opposite sidewalls 59, 60 which extend from the base 57 to the outer face 20 so as to be contiguous therewith at edges 62. The groove bases 57 are spaced from the ledge surfaces 34 so as to leave insulating material therebetween in the thickness direction of the insulating sheet 12.

As such, a depth of each one of the grooves 56 from the outer face 20 of the insulating material 12 to the base 57 is typically less than half of the thickness of the insulating material measured between the inner and outer faces 19, 20 as this is sufficient for the purposes for which the channels 44 are employed as described herein. For example, the grooves 56 may be 0.75 inches deep and 0.5 inches wide from side to side 31. This also leaves sufficient insulating material 12 between the bases 57 of the grooves and the inner face 19 of the insulating sheet 12 to provide substantially similar thermally insulating properties as if there were no such channels present, as in the illustrated arrangement the depth is 18.75% of the thickness of 4 inches of the insulating material between inner and outer faces 19, 20. Also, even though there is a reduced thickness of insulating material between the outer face 20 and the ledge surfaces 34 which are coplanar with the base 54 of the trough 47, the width of the thickened edge portions 40 and the trough 47 are minor in comparison to the overall width of the panel 10 such that the net insulative effect is still relatively high and is further improved by the absence of any thermal bridges as will be better appreciated shortly.

The grooves 56 in the insulating material 12 are arranged in an intersecting array such that at least one of the grooves 56A extends through one other groove 56B transverse thereto, and since the intersecting array of the illustrated arrangement comprises a square grid each groove intersects multiple other grooves with a first set of the grooves including that at 56A extending from one side 14 of the insulating material towards the opposite side 15 in the lateral or perpendicularly transverse direction and a second set of the grooves including that at 56B extending from one end 17 of the insulating material towards the opposite end 18 in the longitudinal direction of the panel. The grooves of the first set are parallel to each other and those of the second set are parallel to each another and perpendicularly transverse to the first set of grooves.

Further, the grooves 56 each extend from a location on the outer face 20 of the insulating material 12, inward of the periphery thereof, to the periphery of the insulating material such that the groove is communicated with an outside of the panel 10. Each groove of the illustrated embodiment extends from the periphery at one side or end of the insulating material to the periphery of the insulating material at an opposite side or end such that the groove is open to the outside of the panel 10 at both terminal ends of the groove.

The grooves 56 are covered by an outer layer 65 of cured composite cementitious material 66 bonded to the outer face 20 of the rigid insulating material 12 and covering a whole of the outer face 20 yet separated from the cured cementitious inner layer 23 by a thickness of the rigid insulating material 12 at the flanges 28, 29, 31 and 32. Thus is formed a plurality of tubular channels 68 which are closed opposite the groove bases 57 to define circumferentially enclosed paths for fluid flow from locations within the periphery of the panel to the outside of the panel. This composite cementitious material 66 is of the same type which forms the inner structural layer 23, and the cured cementitious outer layer 65 has a thickness measured from the outer face 20 of the insulating material to an outer or distal face 70 of the cementitious layer such that a weight of the amount of material forming the layer 65 can be supported in connection with the insulating material by bonding action alone.

The thickness of each of the cured cementitious layers 23, 65 is substantially equal to 0.5 inches, but may generally lie in a first thickness range between 0.25 inches to 1.5 inches or a second thickness range between 0.3 inches to 1 inch.

As the two cementitious layers are connected to the insulating material 12 by bonding action alone, the panel 10 is free of fasteners or anchors directly fastening either one of the layers to the insulating material as by for example metal fasteners passed from the composite cementitious material through the full thickness of the insulating material so as to be anchored to the inner structural layer. As a result the insulating material 12 is uninterrupted by any such non-insulating, thermally conducting object bridging the cured cementitious outer layer 65 and the inner structural layer 23 by extending from a location within or at the least touching the cured cementitious layer at its bonded face which is in contact with the outer face 20 of the insulating material, to a location where this bridging non-insulating object is touching the inner structural layer 23.

It is desirable to make building panels of the type described herein relatively lightweight, as understood in the art, such that the panels can be handled on a construction site and suitably maneuvered into their desired position. By using a relatively thin layer of composite cementitious material, a thickness of the insulating material 12 between its inner and outer faces 19, 20 may be increased from that used in conventional arrangements so as to augment the insulative characteristics, in other words R value, of the panel 10 of the present invention while the panel maintains a suitable weight. Thus, the insulating material 12 may be several times thicker than the cured cementitious layer, for example 3 to 30 times the thickness of the composite cementitious material forming either the inner or outer layer between a face of the insulating sheet 12 and the outer face of that cementitious layer. In the illustrated embodiment, the thickness of the insulating material between the inner and outer faces 19, 20 is substantially equal to 4 inches and is thus 8 times thicker than the cured cementitious layer which is 0.5 inches thick. However, generally speaking, in the panel 10 the thickness of the insulating material may in the order of 3 to 10, 4 to 8 or 5 to 30 times thicker than the cured cementitious layers 23, 65.

The composite cementitious material 66 of the outer layer 65 is not only bonded to the outer face 20 of the insulating material 12 but also wraps about the edges 62 where the outer face meets the groove sidewalls 59, 60, in other words the outer edges of the grooves 56, so as to extend into the grooves 56 and be bonded to a portion of the sidewalls 59, 60 distal to the groove base 57. This provides for a stronger connection to the insulating material 12 than bonding at the planar outer face 20 of the insulating material alone. Furthermore, thus is shown in FIG. 1 where the insulating material 12 and inner layer 23 are cutaway a plurality of intersecting ridges 72 defined on an inner bonded face 73 of the cured cementitious outer layer 65 that correspond to grooves 56 which simply are not fully shown in FIG. 1.

As such, each channel 68 is collectively defined by the composite cementitious material spanning from one sidewall 59 of the groove to the other 60 so as to provide a cured cementitious surface 72A which is not bonded, the base 57 of the groove, and a portion 75 of each one of the sides of the groove extending from the base 57 to a location spaced inwardly from the outer face 20 of the insulating material. Typically the cementitious material extends in the grooves by about one-third of the depth of the grooves 56 leaving about two-thirds of the groove depth void. Thus, generally speaking, the channels each are collectively defined by (i) the groove 30 in the outer face 20 of the insulating material with base 57 recessed from the outer face 20, and (ii) the composite cementitious material 66 spanning across the groove 56 at a location spaced from the base 57 of the groove, so as to be circumferentially closed but open at channel ends which are located at the periphery of the insulating material 12 for fluidic communication with the outside of the panel. The resultantly formed channels 68 have rectangular cross-section.

The channels 68 provide pressure equalization and moisture drainage capabilities to the panel, particularly when the cured cementitious layer of the building panel 10 defines an exterior wall surface of a building, so that the panel can pressure equalize to atmospheric air pressures which increase during high winds and have the tendency to force moisture laden air through cracks or openings, for example pores in concrete, in the cured cementitious outer layer 65. Under such circumstances, any resultant moisture passing through the cured cementitious layer will travel down by gravity through the channels to the bottom of the panel and exit to the exterior.

The cured cementitious outer layer 65 also includes a reinforcing substrate 77 in the form of a mesh substantially spanning the surface area of the outer face 20 of the insulating sheet 12.

A method of forming the panel 10 comprises a step of locating the insulating material 12 with the grooves 56 by lowering the outer face 20 of the insulating material facing downwardly into a body of unset composite cementitious material contained by a form on a horizontal casting bed. As the sheet of insulating material 12 is lowered into the unset composite cementitious material, air may become trapped between the insulating material 12 and the unset composite cementitious material at a location(s) spaced from the periphery of the insulating sheet so as to form an air pocket. However, this trapped air is enabled to escape along the grooves 56 to the outside of the panel. Further, the network of fluidic passageways defined by the grid of grooves 56 provides a discharge path in close proximity to virtually any location on the outer face 20 of the insulating material so that entrapped air can be readily discharged to the outside of the panel without significant (external) downward pressure applied to the panel to force the air out. As such, the composite cementitious material can be bonded across the full surface area of the insulating material's outer face 20.

After doing so, and after the composite cementitious material at the outer face of the insulating material has cured, a casting form is placed at the opposite inner face 19 of the insulating material 12 that is facing upwardly and a layer of composite cementitious material is cast thereon. In this face-up casting of the second cementitious layer, unset composite cementitious material is first poured into the trough 47 and above the ledge surfaces 34, and left to cure so as to bond to the insulating material 12. With these areas containing cured cementitious material level with the inner face 19 of the insulating material, a uniform thickness of unset composite cementitious material is poured across the whole surface area of the inner face 19 and to cover the previously cured portions at the ledge surfaces 34 and trough 47 thereby capping the panel at the inner face of the insulating material.

After the composite cementitious material 66 has cured so as to be bonded to the outer face 20 of the insulating material, the panel 10 is removed from the casting bed by lifting of the panel. The outer face 70 of the cured cementitious outer layer may subsequently be treated such as with paint, acrylic stucco, cork stucco, porcelain tile, siding, and stone and brick veneers so as to provide an ornamental finish to the composite cementitious material and to seal openings therein. For example, if acrylic stucco is the desired ornamental finish, a suitable acrylic stucco primer is applied to the outer face 70 of the cured cementitious layer follow by the acrylic stucco.

Thus is provided a prefabricated insulated building panel which is load bearing, fabricated at a plant so that no further assembly to form the respective panel is required on site, is non-combustible, has a finished exterior, and may include windows installed at the plant which are inserted into an opening 67 formed in the panel.

Figure 6:
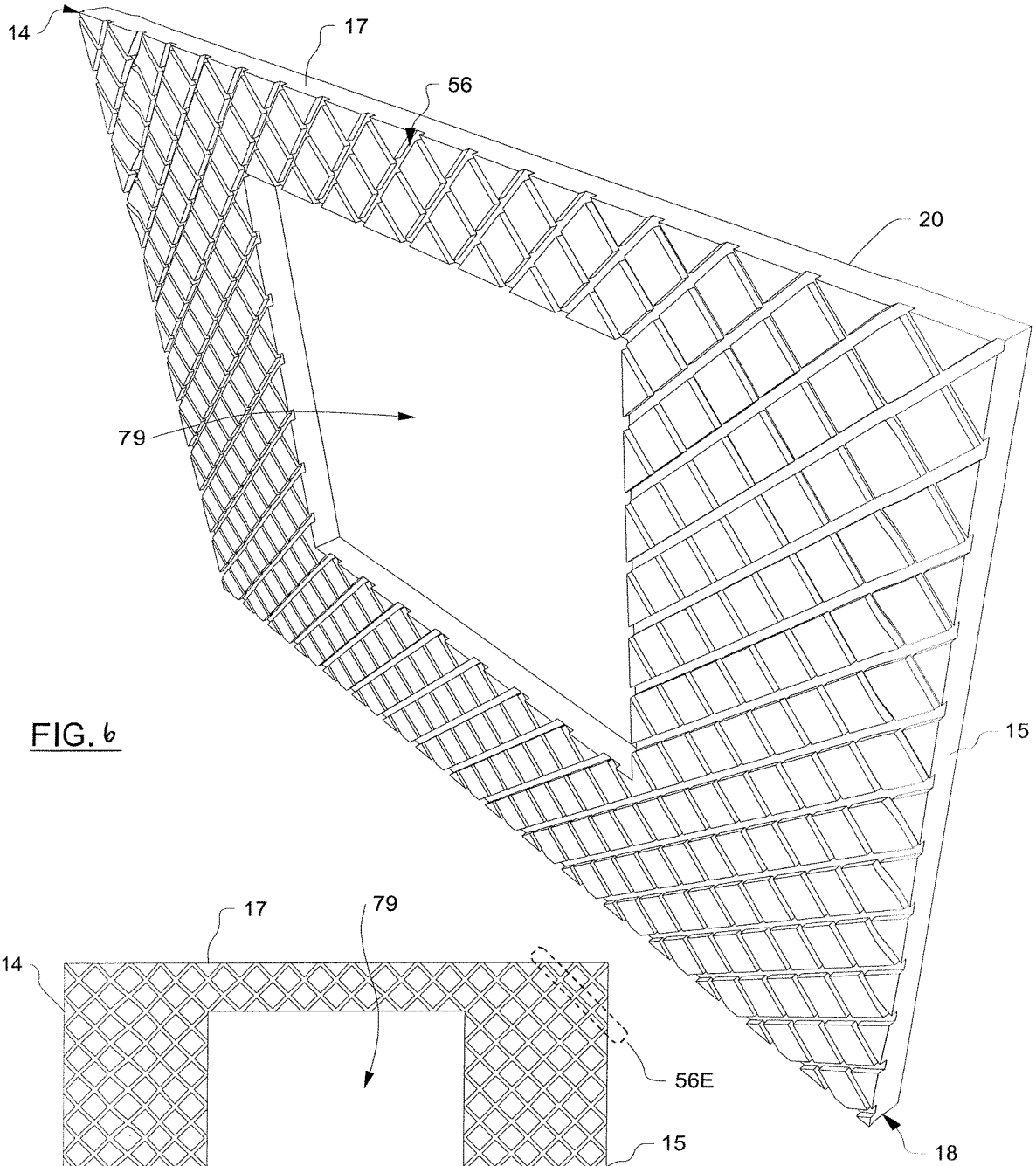
FIG. 6 is a perspective view of another arrangement of prefabricated insulated building panel according to the present invention showing only a rigid insulating material thereof.
Figure 7:
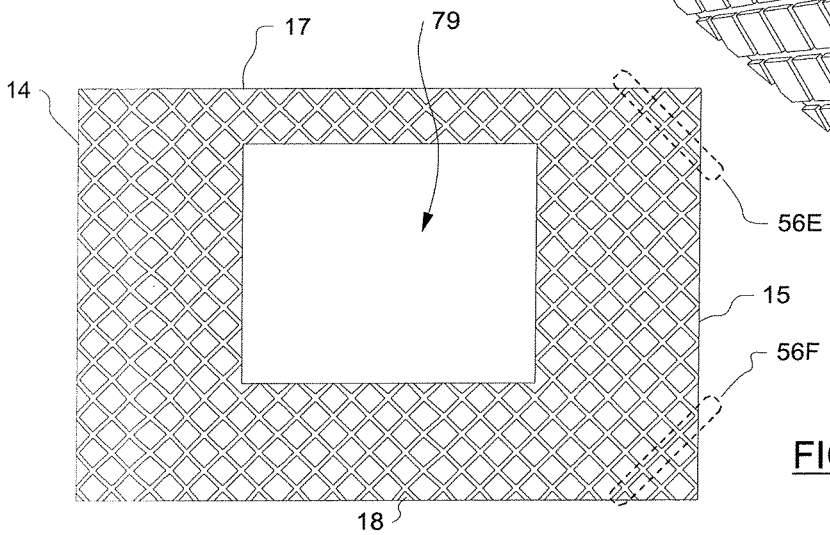
FIG. 7 is an elevational view of the arrangement of FIG. 6.

In FIGS. 6 and 7 is shown a grid array of the grooves in which the grooves extend linearly in a direction from one side 14 or 15 towards an end 17 or 18 thereof so as to be oblique to the longitudinal direction of the panel (from one end 17 to the opposite end 18). For instance, groove 56E indicated in FIG. 7 extends between the side 15 and the end 17 at an oblique angle to the longitudinal direction, and groove 56F extends between the side 15 and end 18 at an oblique angle to the longitudinal direction. Thus, each groove 56 meets the respective side or end of the insulating material 20 at an oblique angle of 45 degrees in the illustrated arrangement. Consequently, particularly when the panel is oriented upright in use as illustrated in FIGS. 6 and 7, in such an arrangement of intersecting grooves there is no horizontal length of channel where moisture can pool or stand allowing gravity to carry the water to the outside of the respective panel along the full length of each groove regardless of which side or end of the panel is at the top in the upright condition of the panel.

It will be appreciated that in some arrangements, particularly where the panel is to be used in forming a wall, the grooves and channels may reach only the ends of the panel and terminate at spaced locations from the sides such that the grid or intersecting array of channels carries water downwardly by gravity and provides continuous, uninterrupted sides for enhanced sealing at joints between horizontally adjacent panels.

It will be appreciated that FIGS. 6 and 7 also show an opening 79 formed centrally of the panel 10 suitable for receiving a 'penetration' in a panel, for example a window or a door.

The panel 10 thus comprises rigid insulating material 20 which is sandwiched between cured composite cementitious layers 23 and 65, each of which is connected at a face 19, 20 of the insulating material by bonding action therewith and therefore comprises a thickness of composite cementitious material allowing same.

The arrangement of panel described herein provide a unitized panel which is both precast concrete and SIP. By employing composite cementitious material such as Ultra High Performance Concrete, the panel can form load bearing walls, floors, roofs and balconies. Due to the thickness of the cured cementitious layers, these layers can be "wet cast" and thus supported in connection with the rigid insulating material by bonding action of the composite cementitious material without any adhesive material between the cured cementitious layer and the insulating material.

Unlike prior art precast concrete sandwich panels, the panel arrangements described herein, which may be referred to as Precast Architectural Concrete (PAC) SIPs for convenient reference, may omit mechanical ties for connecting the cured cementitious layer to remaining portions of the panel including rigid insulating material and panel component as the bonding action alone is sufficient therefor.

The high compressive and flexural characteristics of composite cementitious material such as Ultra High Performance Concrete enable the panels to be stacked as load bearing in multi-storey buildings. Moreover, due to the lightness, the panels can be much larger than all previous panels.

Pressure equalizing air channels behind the exterior concrete layer allow the management of wind driven moisture.

Incorporation of the T-beams and reinforcing substrate sheets in the cured cementitious layers 23, 65 the panel provides additional strength and increases the load which a panel is able to carry. The structures are preferably incorporated when the panel is to be used in the following ways:

i. Vertical, as in the case of exterior foundation walls where earthen fill applies extreme pressure greater than above ground walls
ii. Vertical walls above ground carrying more floors than 2. The taller the building the more pressure on the lower floors.
iii. Vertical panels as walls that are very tall—exceeding 15'
iv. Vertical panels as exterior walls in extreme wind load areas
v. Interior loadbearing demising walls
vi. Elevator shaft walls
vii. Horizontal floor or roof panels carrying increased loads with commercial capacities or greater roof loads due to snow.
viii. Horizontal panels used in parking garages
ix. Balconies with long spans including snow loads The thickened edge portions 40 of the inner structural layer 23 provide suitable surfaces for connecting adjacent panels together so as to form a joint therebetween. The thickened edge portions 40 also serve to protect the joints in the case of a fire.

The channels 68 can be used for other purposes aside from drainage of moisture which penetrates the outer layer 65. For example, the channels 68 may receive electrical wiring, plumbing conduits such as sewer and water lines, in-floor radiant heating pipes, fire sprinkler water lines and sensors.

Joints between adjacent panels can be formed in the following manner:

a) Vertical Joint edges grooves ⅛" wide and ¼" deep are cut into the cured cementitious material along the periphery of the panel;
b) During installation, adjacent panels are spaced apart by about ⅜";
c) Prior to installing the second panel, a double-sided foam seal tape is applied against the rigid insulation. When the second panel is placed in the adjacent location it is pulled into compression against the foam seal tape. This makes the panel joint both water and air tight;
d) On the front side of the panel, a strip of pre-finished sheet metal is slid down from the top of the panel into the grooves that were cut into the concrete veneer of both panels. This provides a visual seal and a practical seal for sun and fire to protect the foam seal directly behind the metal strip;
e) The foam seal on the inside of the panel joint a spray foam is injected into the joint;
f) A foam rod is pressed into the joint to conceal the injected spray foam and to provide a consistent depth for finishing;
g) A polyurethane is caulked and tooled into the inside gapped joint to complete the seal.

Figure 8:
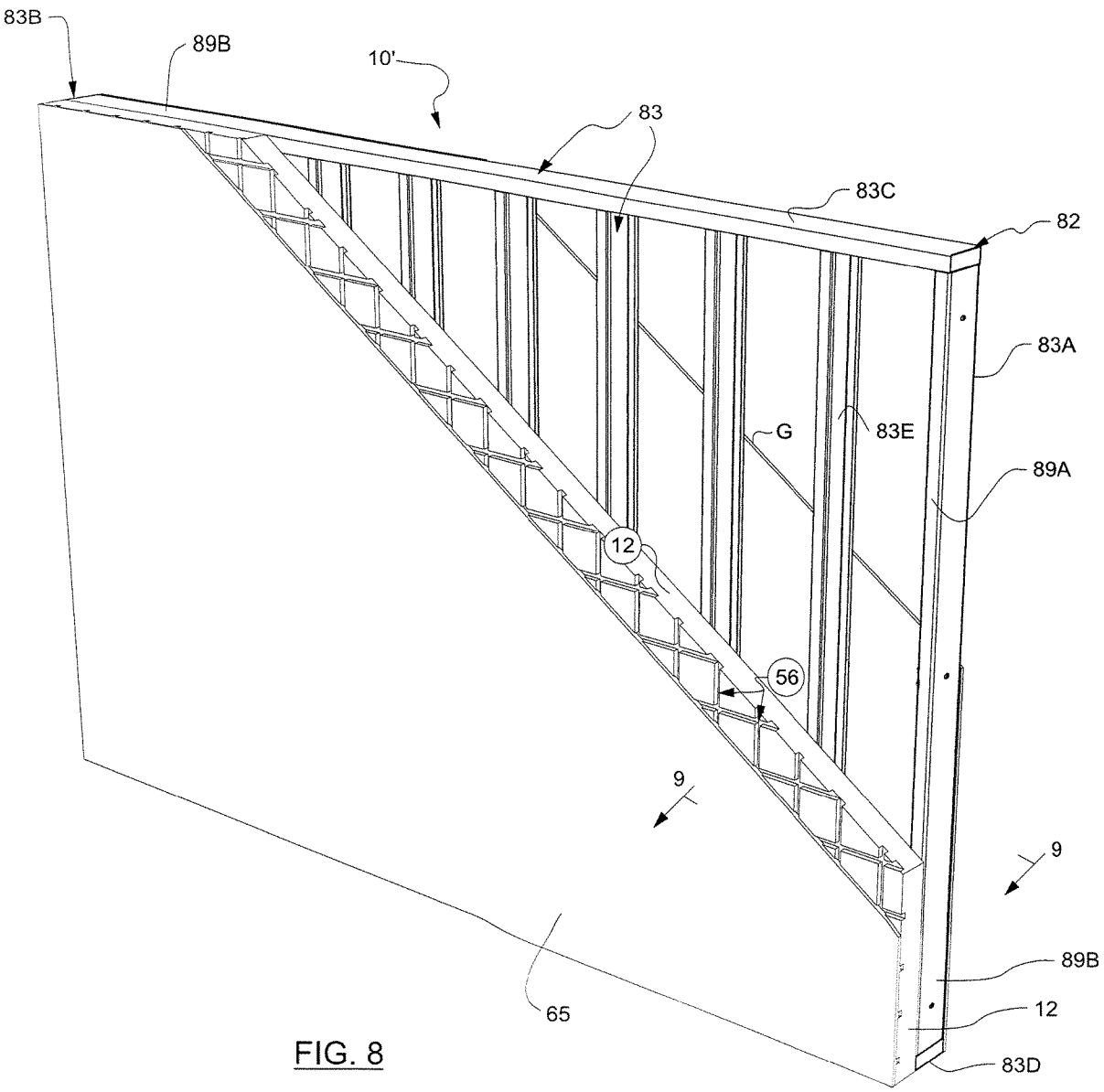
FIG. 8 is a perspective view of a further arrangement of prefabricated insulated building panel the present invention, where a portion of the panel is cutaway so as to view various layers of the panel.
Figure 9:
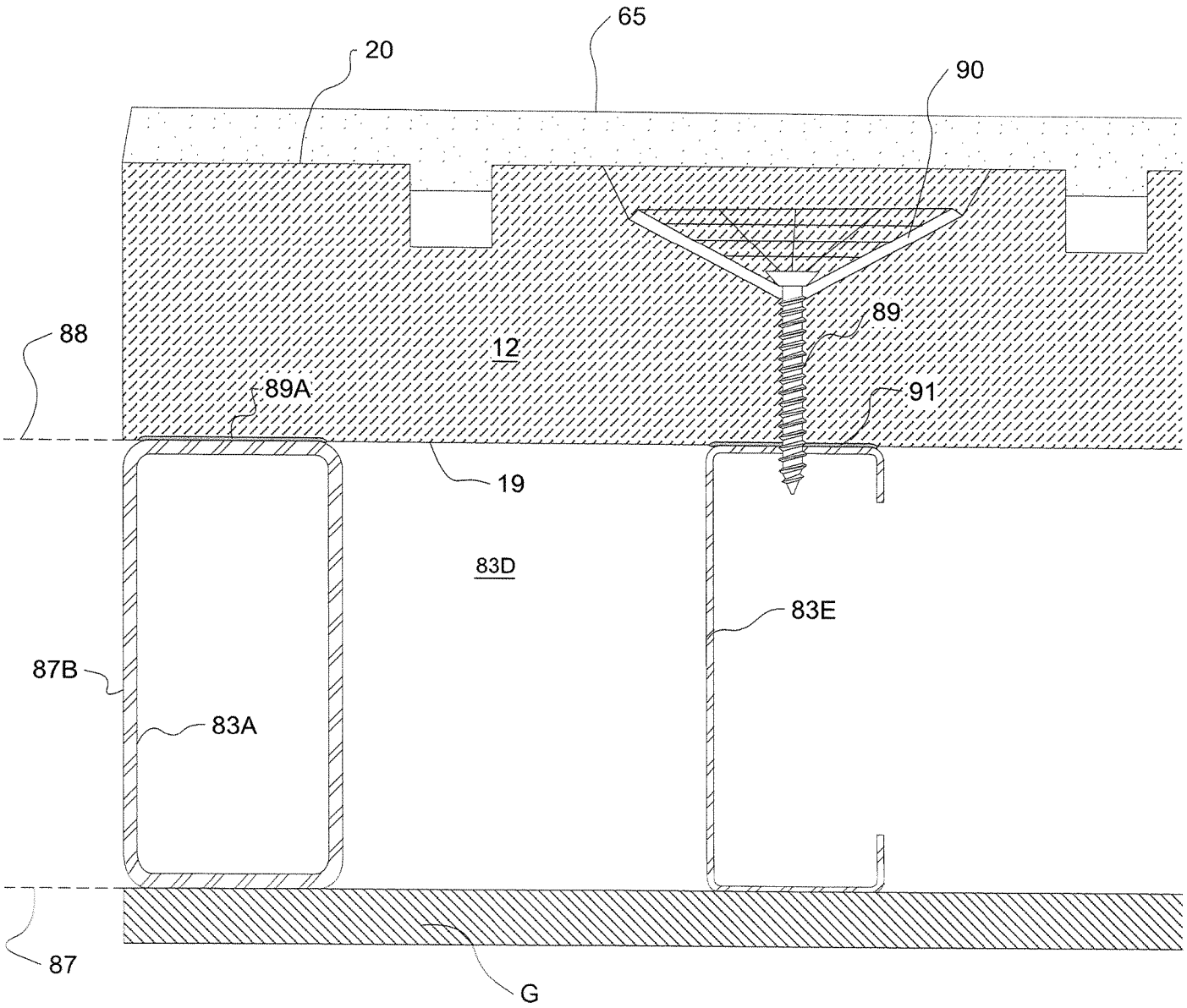
FIG. 9 is a horizontal cross-section along line 9-9 in FIG. 8.

In FIGS. 8 and 9 is shown a variant of the previously described panel 10 which is indicated as panel 10' wherein the inner structural layer comprises a rectangular metal base frame 82 instead of a cured layer of composite cementitious material.

The rectangular metal base frame 82 formed of a plurality of elongate metal members 83 including side members 83A, 83B at opposite sides of the frame and end members 83C, 83D at opposite ends of the frame forming a periphery of the frame. These peripheral members of the frame are tubular. Intermediary metal members 83E are located at uniform intervals between the sides of the frame spanning between the end members 83C, 83D in parallel orientation to the side members 83A, 83B. These interior frame members, located within the frame periphery, may be C-shaped in cross-section with three sides and inwardly projecting flange portions on opposite ends of the fourth side so as to reduce the mass of the frame. Typically, steel members are used to form the frame providing sufficient strength to support loads. The frame thus defines inner and outer planar faces 87 and 88 along narrow faces 89A of the side, intermediary, and end members of the frame defining a thickness of each such member. When used in forming a wall the frame 82 thus forms an interior-most layer of the prefabricated panel, such that at one of the faces 87 a sheet of gypsum (gypsum board) G may be installed to provide a decorative interior surface. The metal frame members may be connected together by fusion, that is by welding, to increase durability and strength as compared to being connected to one another using screw fasteners.

The rigid insulating material 12 is connected to the metal frame 82 with its inner face 19 in abutment with the outer face 88 of the frame.

The panel 10' is constructed by assembling the frame 82 and securing the layer of rigid insulating material 12 to the assembled frame. The rigid insulating material is held in place at the face 88 of the frame by screw fasteners 89 passed through a thickness of the insulating material and fastened to the frame members 13, with plastic umbrella washers 90 diverging from heads of the fasteners 89 so as to enhance hold of the insulating material at the frame by the fasteners, until a polyurethane adhesive 91 applied at the narrow faces 89A of the frame members 83 has cured so as to bond the inner face of the insulating material to the frame 82. Both the washers 90 and the heads of the fasteners 89 are recessed from the outer face 20 of the rigid insulating material so that during casting of the outer cementitious layer neither is disposed in contact with the unset cementitious material, so as to prevent formation of a thermal bridge in the panel.

Then, the partially formed panel including the frame 82 and the insulating material 12 is lowered with the outer face 20 of the insulating material facing downwardly into a body of unset composite cementitious material to form the outer layer 65 of the panel.

The scope of the claims shall not be limited by the preferred embodiments set forth in the examples, but shall be given the broadest interpretation consistent with the description as a whole.

The invention claimed is:

1. A prefabricated insulated building panel comprising:

a sheet of rigid thermally insulating material having opposite first and second sides and opposite first and second ends collectively delimiting a first face and a second face of the sheet which face in opposite directions and collectively defining a periphery of the sheet of rigid thermally insulating material;

at least one of (i) the first and second sides, or (ii) the first and second ends of the rigid thermally insulating material forming a pair of opposite flanges extending outwardly so as to define ledge surfaces along the periphery of the rigid thermally insulating material which are oriented generally parallel to the first face of the rigid thermally insulating material but recessed therefrom so that each one of the ledge surfaces is interconnected with the first face by a transition surface oriented transversely to the respective ledge surface and the first face;

composite cementitious material bonded to the first face, the ledge surfaces and the transition surfaces of the rigid thermally insulating material to provide a first continuous cured cementitious layer extending from one of the ledge surfaces and across the first face of the rigid thermally insulating material to the other one of the ledge surfaces, the first cured cementitious layer having a thickness measured from the first face of the rigid thermally insulating material to an outer face of the first cured cementitious layer that is opposite to said first face and to the ledge surfaces;

composite cementitious material bonded to the second face of the rigid thermally insulating material to provide a second cured cementitious layer with a thickness measured from the second face of the rigid thermally insulating material to an outer face of the second cured cementitious layer opposite thereto; and the first and second cured cementitious layers each being sized in thickness between the outer face thereof and a corresponding one of the first and second faces of the rigid thermally insulating material so as to be supported at the corresponding one of the first and second faces of the rigid thermally insulating material by bonding action therewith.

2. The prefabricated insulated building panel of claim 1 wherein the thickness of each of the first and second cured cementitious layers between the outer face thereof and the corresponding one of the first and second faces of the rigid thermally insulating material is in a range from 0.25 inches to 1.5 inches.

3. The prefabricated insulated building panel of claim 1 wherein the flanges are flush with the second face of the rigid thermally insulating material, such that a surface area of the second face is greater than a surface area of the first face, and the cured cementitious outer layer which covers substantially a whole of the second face of the rigid thermally insulating material is separated from the cured cementitious inner layer by a thickness of the rigid thermally insulating material at the flanges.

4. The prefabricated insulated building panel of claim 1 wherein both (i) the first and second sides, and (ii) the first and second ends of the rigid thermally insulating material respectively form opposite ones of the ledge surfaces such that the first cured cementitious layer is thickened around a whole of the periphery of the sheet of rigid thermally insulating material.

5. The prefabricated insulated building panel of claim 1 wherein the first cured cementitious layer comprises a continuous embedded reinforcing substrate spanning from one of the opposite flanges to the other.

6. The prefabricated insulated building panel of claim 1 wherein each one of the first and second cured cementitious layers is free of interconnecting fasteners which extend from a location within one of the cured cementitious inner and outer layers through a thickness of the rigid thermally insulating material and to the other one of the cured cementitious inner and outer layers so as to interconnect the first and second cured cementitious layers.

* * * * *